US012078390B2

(12) United States Patent
Pickle et al.

(10) Patent No.: US 12,078,390 B2
(45) Date of Patent: Sep. 3, 2024

(54) REHEAT OPERATION FOR HEAT PUMP SYSTEM

(71) Applicant: Johnson Controls Technology Company, Auburn Hills, MI (US)

(72) Inventors: Stephen Blake Pickle, Norman, OK (US); Kerry Lyman Shumway, Norman, OK (US); Thinh Huy Nguyen, Oklahoma City, OK (US); Bradford Graham Briley, Norman, OK (US)

(73) Assignee: TYCO FIRE & SECURITY GMBH, Schaffhausen (CH)

( * ) Notice: Subject to any disclaimer, the term of this patent is extended or adjusted under 35 U.S.C. 154(b) by 0 days.

(21) Appl. No.: 18/241,314

(22) Filed: Sep. 1, 2023

(65) Prior Publication Data

US 2023/0408154 A1 Dec. 21, 2023

Related U.S. Application Data

(63) Continuation of application No. 17/344,675, filed on Jun. 10, 2021, now Pat. No. 11,747,053.

(51) Int. Cl.

| | |
|---|---|
| ***F25B 13/00*** | (2006.01) |
| ***F24F 3/00*** | (2006.01) |
| ***F25B 30/02*** | (2006.01) |

(52) U.S. Cl.

CPC ..... *F25B 13/00* (2013.01); *F24F 3/001* (2013.01); *F25B 30/02* (2013.01); *F25B 2313/027* (2013.01); *F25B 2313/0292* (2013.01); *F25B 2313/0316* (2013.01)

(58) Field of Classification Search

CPC ..... F24F 3/001; F25B 13/00; F25B 2313/027; F25B 2313/0292; F25B 2313/0316; F25B 30/02

See application file for complete search history.

(56) References Cited

U.S. PATENT DOCUMENTS

| | | | | |
|---|---|---|---|---|
| 5,526,650 | A * | 6/1996 | Iritani | B60H 1/00907 62/90 |
| 7,275,384 | B2 | 10/2007 | Taras et al. | |
| 10,066,860 | B2 | 9/2018 | Downie et al. | |
| 10,161,662 | B2 | 12/2018 | Goel et al. | |
| 2004/0089015 | A1* | 5/2004 | Knight | F25B 6/02 62/176.1 |

(Continued)

*Primary Examiner* — Henry T Crenshaw

(74) *Attorney, Agent, or Firm* — Fletcher Yoder, P.C.

(57) ABSTRACT

A heat pump system includes a refrigerant circuit that has a compressor, a first heat exchanger, a second heat exchanger, a reheat heat exchanger, a modulating valve, and a reversing valve. The reversing valve is configured to transition between a first configuration to direct refrigerant from the compressor toward the modulating valve and a second configuration to direct the refrigerant from the compressor toward the first heat exchanger. The heat pump system also includes control circuitry configured to concurrently maintain the reversing valve in the first configuration and adjust a position of the modulating valve to direct a first portion of the refrigerant from the modulating valve to the second heat exchanger and a second portion of the refrigerant from the modulating valve to the reheat heat exchanger based on an operating mode of the heat pump system.

20 Claims, 8 Drawing Sheets

(56) References Cited

U.S. PATENT DOCUMENTS

| | | | | |
|---|---|---|---|---|
| 2006/0053821 | A1* | 3/2006 | Taras | F24F 3/153 62/324.1 |
| 2006/0053823 | A1* | 3/2006 | Taras | F25B 13/00 62/324.1 |
| 2011/0056668 | A1* | 3/2011 | Taras | F28F 9/262 165/174 |
| 2012/0012285 | A1* | 1/2012 | Okamoto | F24F 3/153 165/110 |
| 2016/0104906 | A1* | 4/2016 | Wang | H01M 8/04097 137/12 |
| 2016/0273815 | A1* | 9/2016 | Downie | F25B 49/02 |
| 2017/0151856 | A1* | 6/2017 | Kuwahara | B60H 1/3207 |
| 2019/0178509 | A1* | 6/2019 | Taras | F25B 30/02 |
| 2019/0368754 | A1 | 12/2019 | Blanton | |
| 2022/0299215 | A1* | 9/2022 | Locke | F25B 13/00 |

* cited by examiner

REHEAT OPERATION FOR HEAT PUMP SYSTEM

CROSS REFERENCE TO RELATED APPLICATIONS

This application is a continuation of U.S. patent application Ser. No. 17/344,675, entitled "REHEAT OPERATION FOR HEAT PUMP SYSTEM," filed Jun. 10, 2021, which is hereby incorporated by reference in its entirety for all purposes.

BACKGROUND

This section is intended to introduce the reader to various aspects of art that may be related to various aspects of the present disclosure and are described below. This discussion is believed to be helpful in providing the reader with background information to facilitate a better understanding of the various aspects of the present disclosure. Accordingly, it should be noted that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. An HVAC system may control the environmental properties through control of a supply air flow delivered to the environment. For example, the HVAC system may place the supply air flow in a heat exchange relationship with a refrigerant of a vapor compression circuit to condition the supply air flow. In some embodiments, the HVAC system includes a heat pump system configured to operate in a heating mode to heat the supply air flow and in a cooling mode to cool the supply air flow. Thus, the heat pump system may selectively operate based on a demand for heating or cooling. However, reheat functionality may be difficult and/or costly to incorporate in the heat pump system.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heat pump system includes a refrigerant circuit that has a compressor, a first heat exchanger, a second heat exchanger, a reheat heat exchanger, a modulating valve, and a reversing valve. The reversing valve is configured to transition between a first configuration to direct refrigerant from the compressor toward the modulating valve and a second configuration to direct the refrigerant from the compressor toward the first heat exchanger. The heat pump system also includes control circuitry configured to control operation of the reversing valve and the modulating valve. The control circuitry is configured to concurrently maintain the reversing valve in the first configuration, such that the refrigerant is received at the modulating valve from the reversing valve, and adjust a position of the modulating valve to direct a first portion of the refrigerant received at the modulating valve to the second heat exchanger and a second portion of the refrigerant received at the modulating valve to the reheat heat exchanger based on an operating mode of the heat pump system.

In one embodiment, a tangible, non-transitory, computer-readable medium comprising instructions. The instructions, when executed by processing circuitry, are configured to cause the processing circuitry to position a reversing valve of a heat pump system in a first configuration to direct refrigerant from a compressor of the heat pump system toward an indoor heat exchanger of the heat pump system in a heating mode of the heat pump system, position the reversing valve in a second configuration to direct the refrigerant from the compressor toward a modulating valve of the heat pump system in a modulating reheat mode of the heat pump system, and adjust a position of the modulating valve to direct a first portion of the refrigerant from the reversing valve to an outdoor heat exchanger of the heat pump system and to direct a second portion of the refrigerant from the reversing valve to a reheat heat exchanger of the heat pump system in the modulating reheat mode.

In one embodiment, a heat pump system includes a refrigerant circuit having a compressor, an indoor heat exchanger, an outdoor heat exchanger, a reheat heat exchanger, a modulating valve, and a reversing valve. The reversing valve is configured to receive refrigerant from the compressor and adjust between a first configuration to direct the refrigerant from the compressor toward the modulating valve and a second configuration to direct the refrigerant from the compressor toward the indoor heat exchanger. The modulating valve is configured to apportion the refrigerant received from the reversing valve between the outdoor heat exchanger and the reheat heat exchanger.

BRIEF DESCRIPTION OF THE DRAWINGS

Various aspects of this disclosure may be better understood upon reading the following detailed description and upon reference to the drawings in which.

DETAILED DESCRIPTION

Figure 1:
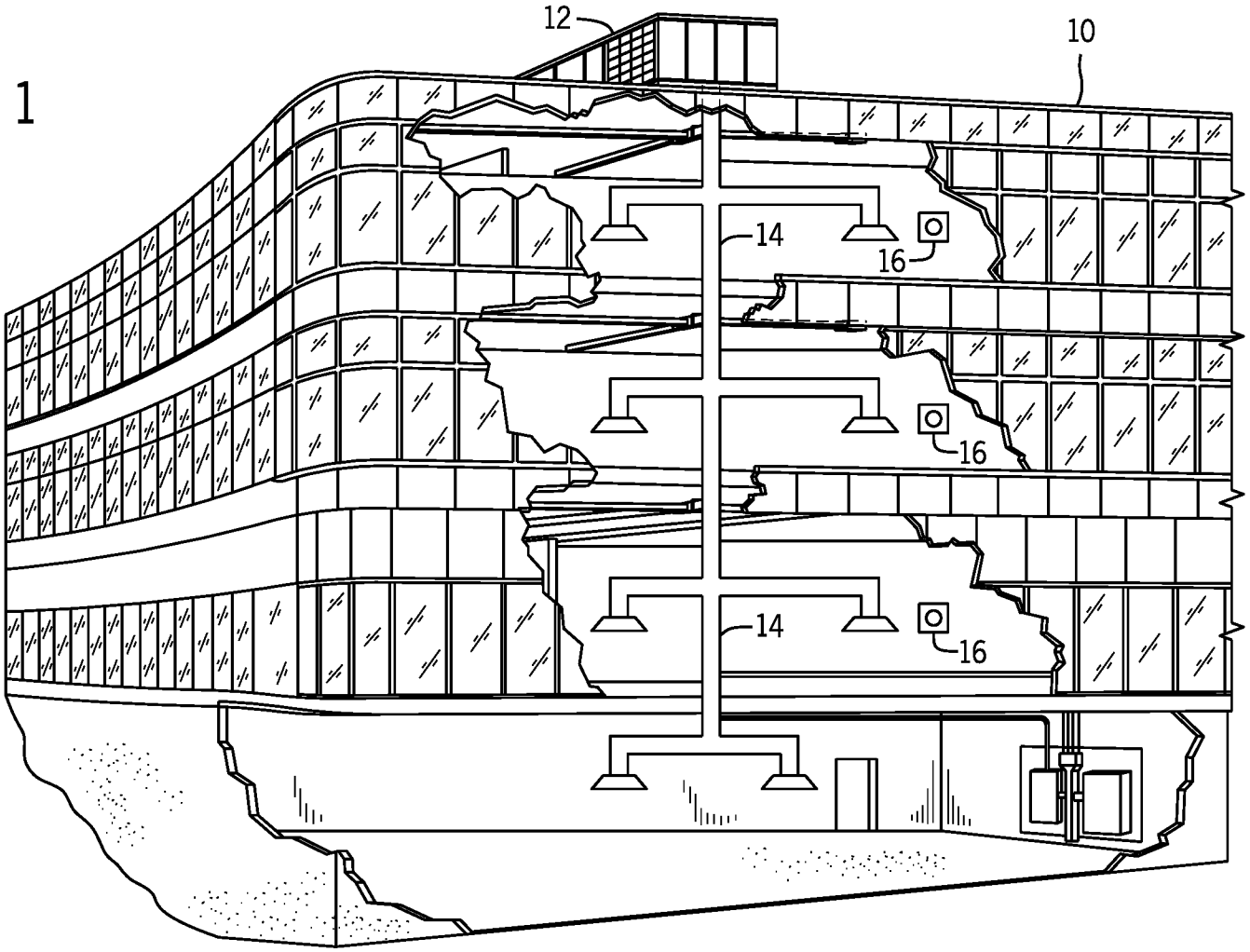
FIG. 1 is a perspective view of an embodiment of a heating, ventilation, and/or air conditioning (HVAC) system for environmental management that may employ one or more HVAC units, in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

The present disclosure is directed to a heating, ventilation, and/or air conditioning (HVAC) system. The HVAC system may include a refrigerant circuit through which a refrigerant is directed. The refrigerant circuit may place the refrigerant in a heat exchange relationship with a supply air flow to condition the supply air flow. The conditioned supply air flow may then be delivered to a space to condition the space. The HVAC system may include a heat pump system configured to operate in a heating mode or a cooling mode. In the heating mode, the HVAC system may circulate refrigerant through the refrigerant circuit in a first direction (e.g., along a first flow path), and the refrigerant may transfer heat to the supply air flow to heat the supply air flow provided to the space. In the cooling mode, the HVAC system may circulate refrigerant through the refrigerant circuit in a second direction (e.g., along a second flow path), and the refrigerant may absorb heat from the supply air flow to cool the supply air flow provided to the space. For example, the refrigerant circuit may include a reversing valve configured to adjust a direction of refrigerant flow through the refrigerant circuit and thereby adjust the operating mode of the heat pump system (e.g., between the heating mode and the cooling mode).

In certain embodiments, it may be desirable to reheat the supply air flow after the supply air flow has been cooled by the refrigerant. For example, the refrigerant may initially absorb a certain amount of heat from the supply air flow to remove a target amount of liquid from the supply air flow (e.g., to dehumidify the supply air flow), which may reduce a temperature of the supply air flow below a comfortable, desirable, or target temperature. Thus, reheating the air flow may be desirable to increase the temperature of the supply air flow to the comfortable, desirable, or target temperature. Unfortunately, it may be difficult to provide reheat functionality in the heat pump system. As an example, refrigerant circuits of conventional or existing heat pump systems may not have a reheat heat exchanger to reheat the supply air flow via the refrigerant. As mentioned above, heat pump systems include a refrigerant circuit configured to direct refrigerant therethrough in multiple, different directions (e.g., depending on an operating mode of the heat pump system), which may complicate incorporation of a reheat system with the heat pump system. As another example, a cost associated with incorporating and/or operating a reheat system that is separate from the refrigerant circuit of the heat pump system (e.g., a gas furnace or electric heating coil) may be undesirable.

Accordingly, embodiments of the present disclosure are directed to a heat pump system having a refrigerant circuit configured to provide reheat functionality (e.g., configured to enable operation of the HVAC system in a modulating reheat mode). For example, the refrigerant circuit may include a first heat exchanger (e.g., an indoor heat exchanger), a second heat exchanger (e.g., an outdoor heat exchanger), and a reheat heat exchanger. In a heating mode, a reversing valve may be adjusted to a first configuration to direct pressurized refrigerant from a compressor of the refrigerant circuit to the first heat exchanger. The first heat exchanger may enable the pressurized, heated refrigerant to transfer heat to a supply air flow directed across the first heat exchanger, thereby heating the supply air flow to be provided to a conditioned space.

In a modulating reheat mode, the reversing valve may be adjusted to a second configuration to direct the refrigerant from the compressor to a modulating valve of the refrigerant circuit. The modulating valve may be adjusted to direct a first portion of the refrigerant received from the reversing valve to the second heat exchanger and direct a second portion of the refrigerant received from the reversing valve to the reheat heat exchanger. At the reheat heat exchanger, heat is transferred from the refrigerant to the supply air flow, thereby cooling the refrigerant and heating the supply air flow. From the reheat heat exchanger, the refrigerant circuit may direct the refrigerant to the first heat exchanger, where the cooled refrigerant may absorb heat from the supply air flow and, in some instances, condense moisture in the supply air flow to dehumidify the supply air flow. In this way, the reheat heat exchanger may enable heat exchange between the supply air flow and heated refrigerant, and the first heat exchanger may enable heat exchange between the supply air flow and cooled refrigerant. For example, the reheat heat exchanger may be downstream from the first heat exchanger relative to a flow direction of the supply air flow. The modulating reheat mode may enable the heat pump system to deliver a dehumidified supply air flow at a comfortable temperature to the conditioned space.

The modulating valve may be controlled to adjust the amount of the first portion of the refrigerant directed to the second heat exchanger and the amount of the second portion of the refrigerant directed to the reheat heat exchanger. For instance, the modulating valve may be configured to adjust between a first position (e.g., a position that may direct all of the refrigerant from the compressor or reversing valve to the second heat exchanger for increased cooling and/or dehumidification of the supply air flow) and a second position (e.g., a position that may direct all of the refrigerant from the compressor or reversing valve to the reheat heat exchanger for increased reheat of the supply air flow), as well as any of a plurality of positions (e.g., intermediate positions) between the first position and the second position. Thus, the modulating valve may be adjusted to control the temperature and/or the humidity of the supply air flow more acutely.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
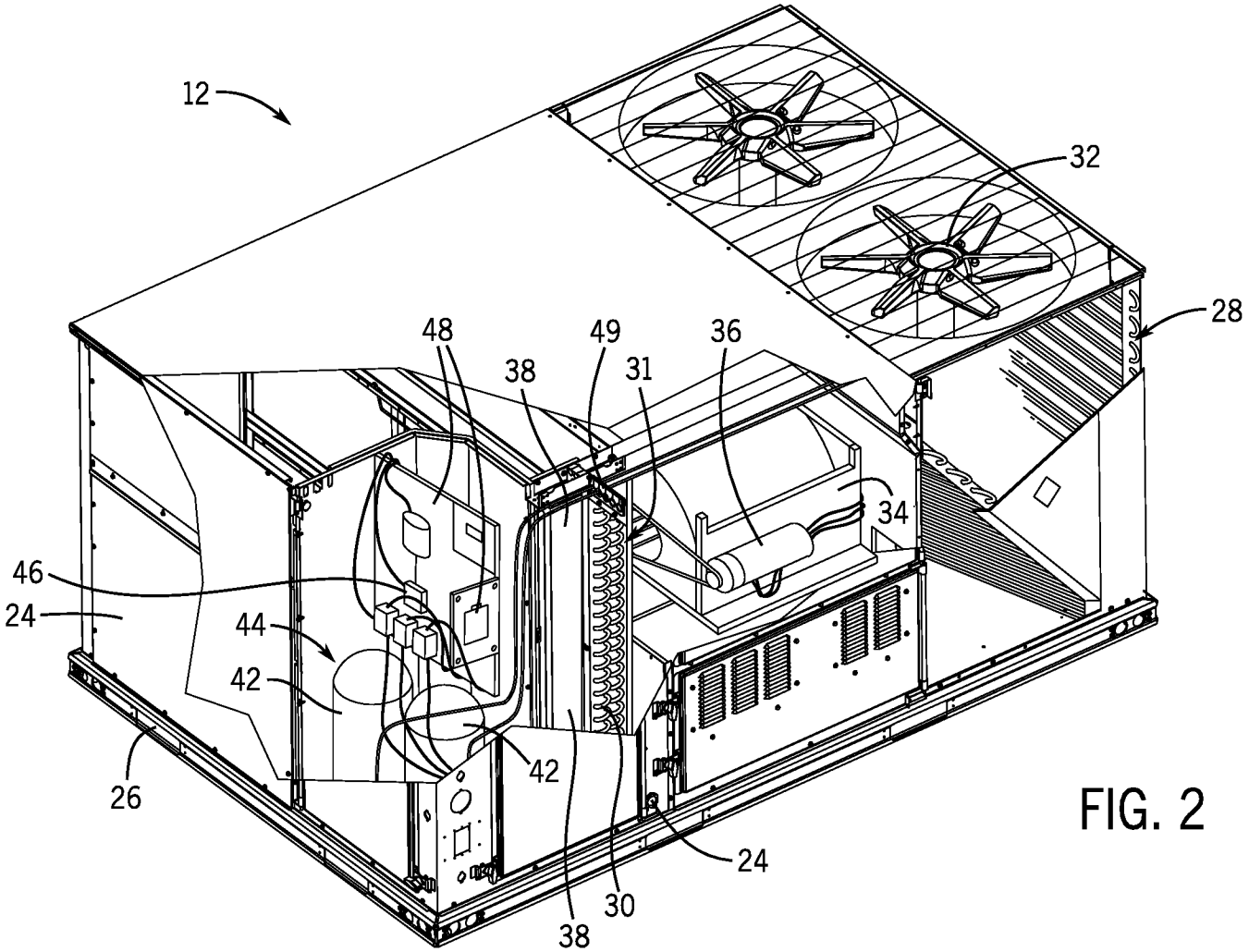
FIG. 2 is a perspective view of an embodiment of a packaged HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit onto "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. Additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
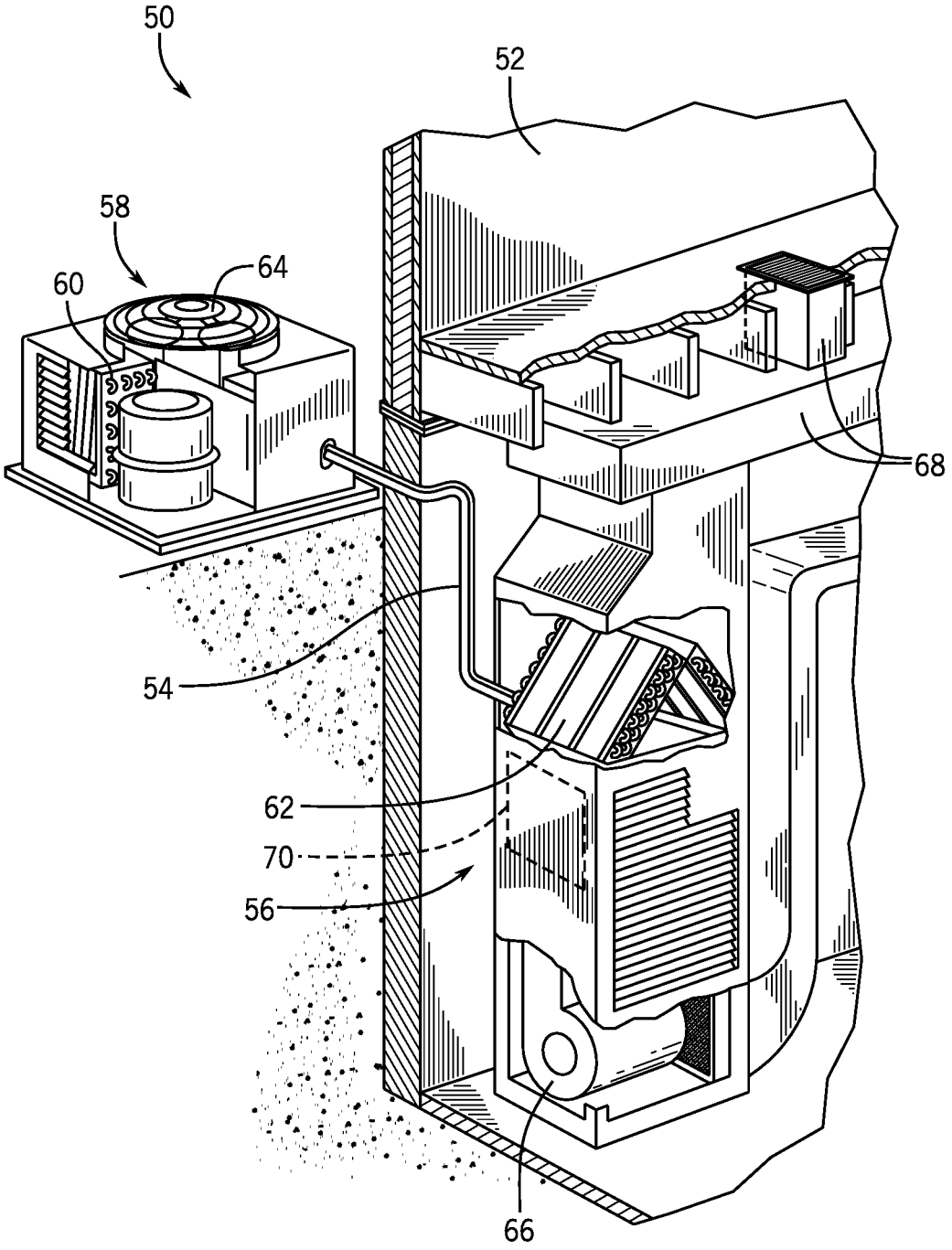
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
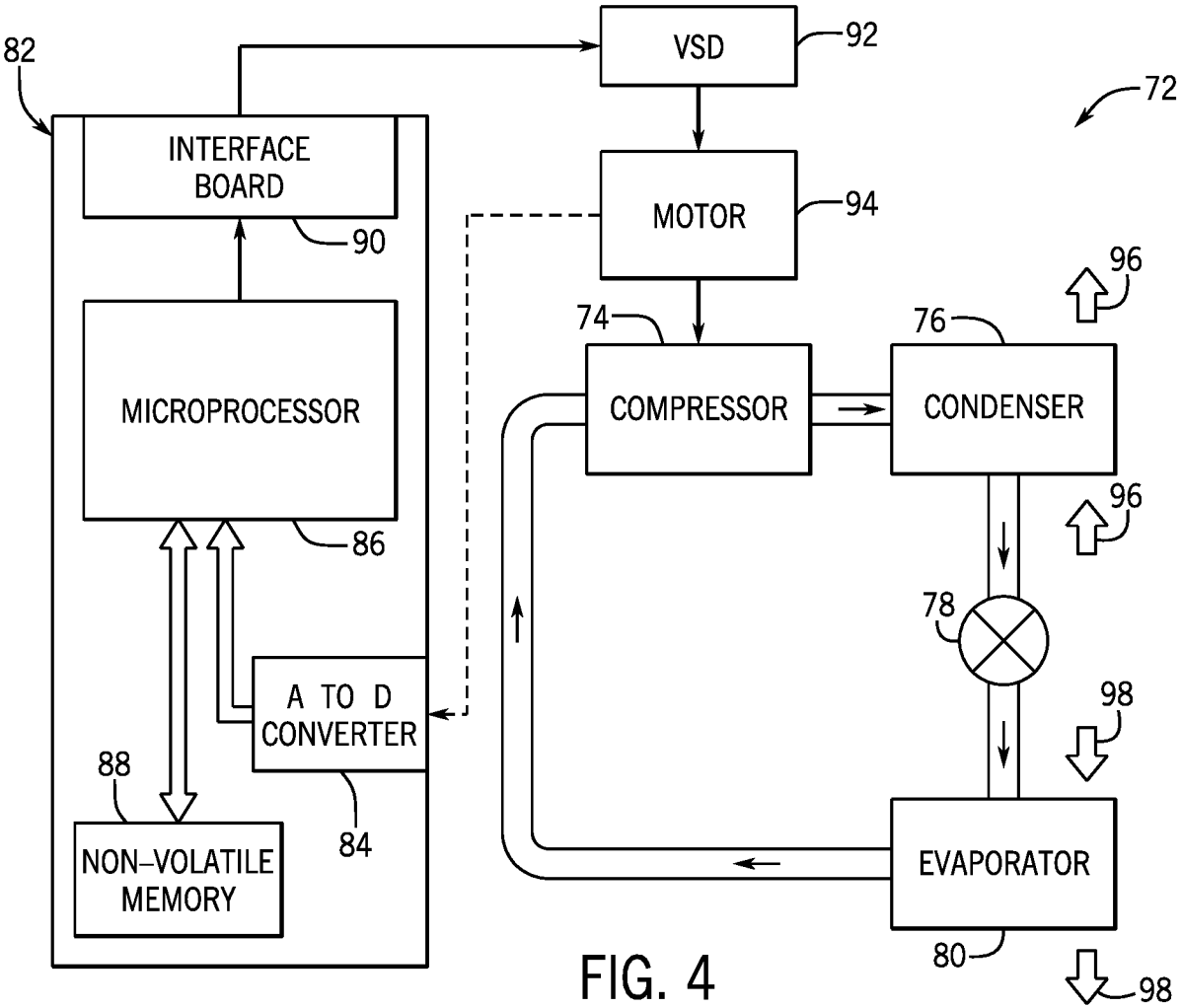
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil (e.g., a reheat heat exchanger) in addition to the evaporator 80 and the condenser 76. For example, the reheat coil may be positioned downstream of the evaporator 80 relative to the supply air stream 98 and may reheat the supply air stream 98, such as in a dehumidification or modulating reheat mode of the vapor compression system 72. That is, the supply air stream 98 may be overcooled to remove humidity from the supply air stream 98, and the reheat coil may subsequently reheat the supply air stream 98 before the supply air stream 98 is directed to the building 10 or the residence 52.

Any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As mentioned above, the present disclosure is directed to a heat pump system having a refrigerant circuit configured to operate in a heating mode, a modulating reheat mode, and a cooling mode. In the heating mode, refrigerant is directed through the refrigerant circuit from a compressor to a first heat exchanger (e.g., an indoor heat exchanger) to enable the refrigerant to heat a supply air flow. In the modulating reheat mode, the refrigerant is directed through the refrigerant circuit from the compressor to a modulating valve. The modulating valve may apportion the flow of refrigerant between a second heat exchanger (e.g., an outdoor heat exchanger) to cool the refrigerant and a reheat heat exchanger to heat (e.g., reheat) the supply air flow and cool the refrigerant. The cooled refrigerant from the second heat exchanger and the reheat heat exchanger is directed to the first heat exchanger to cool the supply air flow. For example, the first heat exchanger may be positioned upstream of the reheat heat exchanger relative to a flow direction of the supply air flow. Thus, in the modulating reheat mode, the heat pump system may cool the supply air flow, via the first heat exchanger to remove an amount of moisture in the supply air flow, for example, and then reheat the supply air flow, via the reheat heat exchanger, to a target or desirable temperature. The modulating valve may be adjusted to control conditioning of the supply air flow more acutely. For example, the modulating valve may be controlled to adjust the amount of refrigerant directed to the second heat exchanger relative to the amount of refrigerant directed to the reheat heat exchanger in order to control cooling and/or dehumidification of the supply air flow more acutely. In the cooling mode, all refrigerant may be directed through the refrigerant circuit from the compressor to the second heat exchanger (e.g., via the modulating valve) to cool the refrigerant via an ambient air flow, and the cooled refrigerant may then be directed to the first heat exchanger to cool the supply air flow (e.g., without reheating the refrigerant via the reheat heat exchanger).

Figure 5:
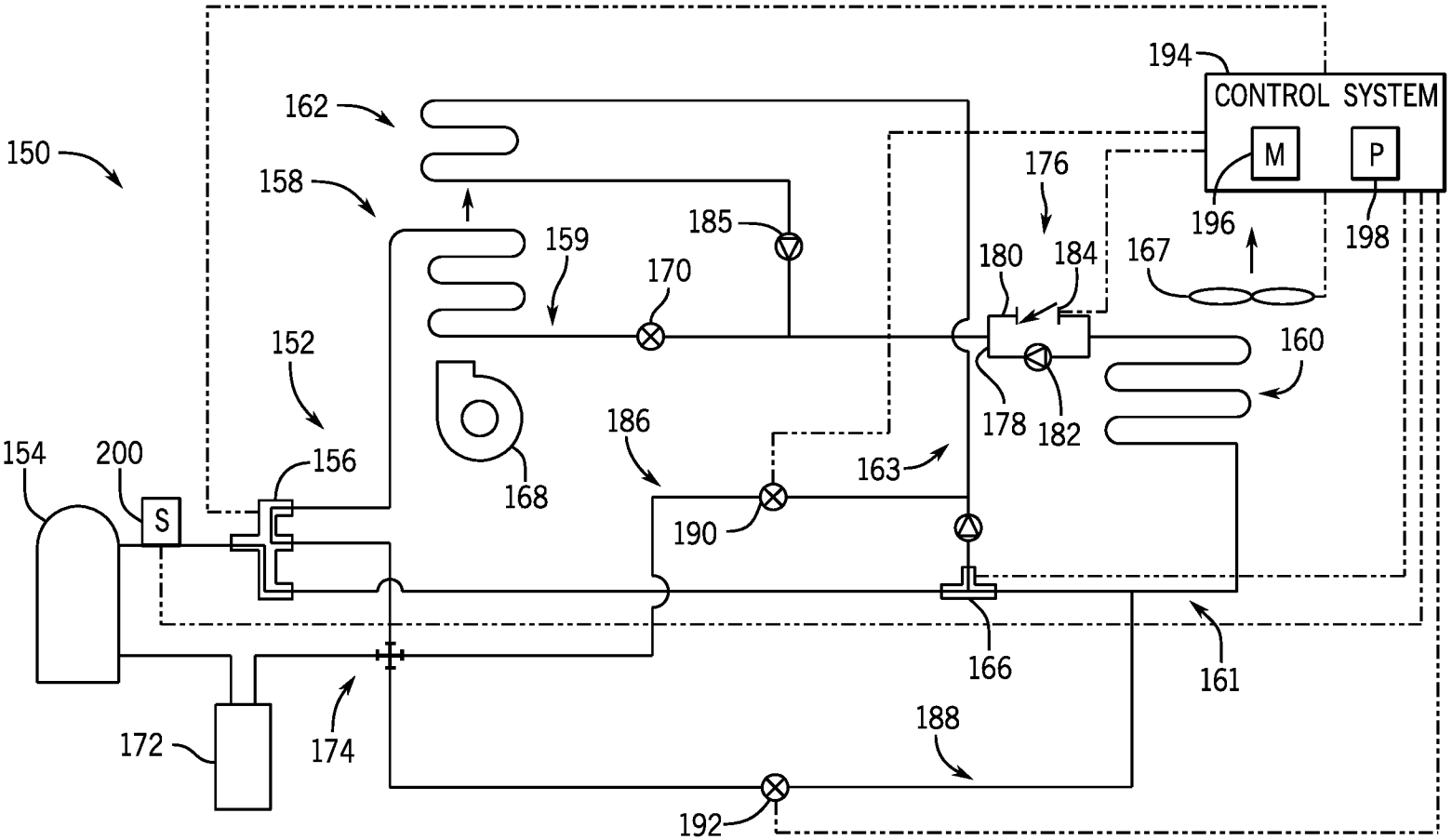
FIG. 5 is a schematic diagram of an embodiment of a heat pump system having reheat functionality and operating in a modulating reheat mode, in accordance with an aspect of the present disclosure.

With this in mind, FIG. 5 is a schematic diagram of an embodiment of a heat pump system 150 having a refrigerant circuit 152 through which a refrigerant is directed. The refrigerant circuit 152 includes a compressor 154 configured to pressurize the refrigerant, thereby increasing a temperature of the refrigerant. The refrigerant circuit 152 includes a reversing valve 156 configured to receive the pressurized refrigerant from the compressor 154. The reversing valve 156 may be transitioned between different configurations (e.g., by adjusting the position of a slider within the reversing valve 156) to direct the refrigerant in different manners (e.g., in different directions, along different flow paths) through the refrigerant circuit 152. For example, the refrigerant circuit 152 may include a first heat exchanger or coil 158 (e.g., an indoor heat exchanger or coil) disposed along a first flow path 159 (e.g., a first conduit section, a first line) of the refrigerant circuit 152 and a second heat exchanger or coil 160 (e.g., an outdoor heat exchanger or coil) disposed along a second flow path 161 (e.g., a second conduit section, a second line) of the refrigerant circuit 152. The reversing valve 156 may be controlled (e.g., adjusted) to direct the refrigerant through the refrigerant circuit 152 in different flow directions. For example, the reversing valve 156 may be controlled to direct the refrigerant through components of the refrigerant circuit 152 (e.g., the compressor 154, the first heat exchanger 158, the second heat exchanger 160) in a particular order or sequence.

Further, the refrigerant circuit 152 may include a reheat heat exchanger or coil 162 disposed along a reheat flow path 163 (e.g., a reheat conduit section, a reheat line) of the refrigerant circuit 152, as well as a first valve 166 (e.g., a three-way valve, a modulating valve) configured to adjustably apportion refrigerant flow (e.g., received from the reversing valve 156) between the second heat exchanger 160 and the reheat heat exchanger 162. For example, the first valve 166 may be a modulating valve configured to transition between a first position (e.g., in a cooling mode of the heat pump system 150), which may block refrigerant flow into and/or out of the reheat flow path 163, a second position (e.g., in a reheat mode of the heat pump system 150), which may block refrigerant flow into and/or out of the second flow path 161, and a plurality of intermediate positions between the first position and the second position to split or divide refrigerant flow between the reheat flow path 163 and the second flow path 161.

In the illustrated embodiment, the heat pump system 150 is shown in a modulating reheat mode. In the modulating reheat mode, the reversing valve 156 is maintained in a first configuration to direct pressurized refrigerant from the compressor 154 toward the first valve 166. The first valve 166 is positioned to direct a first portion of the refrigerant received from the reversing valve 156 to the second heat exchanger 160 via the second flow path 161 and a second portion of the refrigerant received from the reversing valve 156 to the reheat heat exchanger 162 via the reheat flow path 163. That is, the first valve 166 may apportion refrigerant between the second heat exchanger 160 and the reheat heat exchanger 162. A first fan or blower 167 (e.g., an outdoor fan or blower) may be operated to direct (e.g., draw, force) an air flow, such as outdoor air and/or ambient air, across the second heat exchanger 160 to cool the pressurized, heated first portion of the refrigerant flowing within the second heat exchanger 160. A second fan or blower 168 (e.g., an indoor fan or blower) may direct (e.g., draw, force) a supply air flow, such as outdoor air and/or return air, across the reheat heat exchanger 162. Thus, the reheat heat exchanger 162 may place the pressurized, heated second portion of the refrigerant in a heat exchange relationship with the supply air flow to heat (e.g., reheat) the supply air flow and cool the second portion of the refrigerant.

In the modulating reheat mode, an expansion valve 170 may receive a combination of the cooled first portion of the refrigerant from the second heat exchanger 160 and the cooled second portion of the refrigerant from the reheat heat exchanger 162. The expansion valve 170 may be configured to reduce the pressure of the refrigerant, thereby further cooling the refrigerant. The expansion valve 170 may direct the cooled refrigerant to the first heat exchanger 158 via the first flow path 159. The second fan 168 may also direct the supply air flow across the first heat exchanger 158. The cooled refrigerant flowing through the first heat exchanger 158 may absorb heat from the supply air flow, thereby cooling the supply air flow. As shown, the first heat exchanger 158 is positioned upstream of the reheat heat exchanger 162 relative to the supply air flow directed thereacross. Thus, the first heat exchanger 158 may first cool the supply air flow to condense moisture contained within the supply air flow, thereby reducing the temperature and humidity of the supply air flow, and the reheat heat exchanger 162 may heat (e.g., reheat) the cooled, dehumidified supply air flow to a comfortable or desired temperature. The supply air flow may then be directed to a space (e.g., within a building or structure) to condition the space.

After exchanging heat with the supply air flow, the refrigerant may be directed from the first heat exchanger 158 to the reversing valve 156. In some embodiments, the reversing valve 156 may direct the refrigerant from the first heat exchanger 158 to an accumulator 172 via a junction 174 of the refrigerant circuit 152. The accumulator 172 may collect refrigerant and/or direct the refrigerant to the compressor 154 for pressurization (e.g., during operation of the compressor 154) to re-circulate the refrigerant through the refrigerant circuit 152.

The heat pump system 150 may include a conduit system 176 to control refrigerant flow through the second flow path 161. The conduit system 176 may extend between the first heat exchanger 158 and the second heat exchanger 160 and may include a first conduit 178 and a second conduit 180 arranged in parallel with one another. The first conduit 178 may include a check valve 182 configured to enable refrigerant flow (e.g., in a first direction) from the second heat exchanger 160 toward the expansion valve 170 and the first heat exchanger 158 via the first conduit 178. The check valve 182 may also block refrigerant flow (e.g., in a second direction) from the expansion valve 170 and/or from the reheat heat exchanger 162 to the second heat exchanger 160 via the first conduit 178. In addition, the second conduit 180 may include a second valve 184 (e.g., an on/off valve) that may transition between an open (e.g., on) position and a closed (e.g., off) position. In the open position, the second valve 184 may enable refrigerant flow (e.g., in the second direction) through the second conduit 180 (e.g., between the expansion valve 170 and the second heat exchanger 160). In the closed position, the second valve 184 may block refrigerant flow (e.g., in the first direction and the second direction) through the second conduit 180. As an example, in the modulating reheat mode, the second valve 184 may be adjusted to the closed position to block refrigerant flow from the reheat heat exchanger 162 and/or from the expansion valve 170 to the second heat exchanger 160 via the conduit system 176. Thus, the refrigerant may be directed to flow from the second heat exchanger 160 (e.g., via the first conduit 178) and from the reheat heat exchanger 162 to the expansion valve 170.

The heat pump system 150 may also include a check valve 185 disposed along the reheat flow path 163. The check valve 185 may enable refrigerant flow from the reheat heat exchanger 162 out of the reheat flow path 163 (e.g., toward the expansion valve 170). However, the check valve 185 may block refrigerant flow from the first heat exchanger 158 and/or from the second heat exchanger 160 to the reheat heat exchanger 162. Thus, the check valve 185 may enable refrigerant flow from the reheat heat exchanger 162 to the first heat exchanger 158 and/or between the first heat exchanger 158 and the second heat exchanger 160.

The illustrated heat pump system 150 also includes a first drain flow path 186 (e.g., a first drain line, a first drain conduit) and a second drain flow path 188 (e.g., a second drain line, a second drain conduit). Each of the drain flow paths 186, 188 may enable refrigerant flow from an unused (e.g., non-operating) section of the refrigerant circuit 152 toward the accumulator 172 and/or toward the compressor 154 in order to increase an amount of refrigerant available for pressurization by the compressor 154. For example, the first drain flow path 186 may enable refrigerant flow from the reheat flow path 163 to the junction 174, and the second drain flow path 188 may enable refrigerant flow from the second flow path 161 to the junction 174.

Thus, when the first valve 166 is in the first position to block refrigerant flow into the reheat flow path 163 (e.g., the reheat heat exchanger 162 is not in operation, the second heat exchanger 160 is in operation), a third valve 190 (e.g., an on/off valve) disposed along the first drain flow path 186 may be adjusted to an open position to enable refrigerant flow out of the reheat flow path 163 to the accumulator 172. In other words, any refrigerant remaining in the reheat flow path 163 and/or the reheat heat exchanger 162 from prior operation of the reheat heat exchanger 162 may be directed through first drain flow path 186 to the junction 174. Further, when the first valve 166 is in the first position, a fourth valve 192 (e.g., an on/off valve) disposed along the second drain flow path 188 may be adjusted to a closed position to block refrigerant flow between the second flow path 161 and the junction 174 and enable refrigerant flow from the second flow path 161 (e.g., from the second heat exchanger 160) toward the first heat exchanger 158.

Additionally, when the first valve 166 is in the second position to block refrigerant flow into the second flow path 161 (e.g., the second heat exchanger 160 is not in operation, the reheat heat exchanger 162 is in operation), the fourth valve 192 may be adjusted to the open position to enable refrigerant flow out of the second flow path 161 to the accumulator 172. That is, any remaining refrigerant within the second flow path 161 and/or the second heat exchanger 160 from prior operation of the second heat exchanger 160 may be directed from the second flow path 161 to the junction 174. Moreover, when the first valve 166 is in the second position, the third valve 190 may be adjusted to the closed position to block refrigerant flow between the reheat flow path 163 and the junction 174 and thereby enable refrigerant flow from the reheat flow path 163 (e.g., from the reheat heat exchanger 162) toward the first heat exchanger 158. Further still, when the first valve 166 is in any of the intermediate positions between the first position and the second position, each of the valves 190, 192 may be adjusted to the closed position to block refrigerant flow between the second flow path 161 and the junction 174 and between the reheat flow path 163 and the junction 174. Thus, refrigerant from both the second flow path 161 and the reheat flow path 163 may be directed to the first heat exchanger 158.

The heat pump system 150 may operate in the modulating reheat mode to provide more acute control in conditioning the supply air flow. In the modulating reheat mode, the first valve 166 may be controlled to adjust the amount of the first portion of the refrigerant directed to the second heat exchanger 160 relative to the amount of the second portion of the refrigerant directed to the reheat heat exchanger 162. By way of example, the first valve 166 may be adjusted to increase the amount of the second portion of the refrigerant directed to the reheat heat exchanger 162 (e.g., decrease the amount of the first portion of the refrigerant directed to the second heat exchanger 160) in order to increase heating (e.g., reheating) of the supply air flow, thereby increasing a temperature of the supply air flow provided by the heat pump system 150. The first valve 166 may also be adjusted to increase the amount of the first portion of the refrigerant directed to the second heat exchanger 160 (e.g., decrease the amount of the second portion of the refrigerant directed to the reheat heat exchanger 162) in order to reduce heating (e.g., reheating) of the supply air flow, thereby reducing a temperature of the supply air flow provided by the heat pump system 150. For instance, the first valve 166 may be adjusted to dehumidify the space serviced by the heat pump system 150 (e.g., to reduce humidity in the space by a desired amount) and to condition the space to a target or desired temperature (e.g., to maintain a current temperature of the space).

To this end, the heat pump system 150 may also include a control system 194 configured to control various components of the heat pump system 150. The control system 194 may include a memory 196 and processing circuitry 198. The memory 196 may include a tangible, non-transitory, computer-readable medium that may store instructions that, when executed by the processing circuitry 198, may cause the processing circuitry 198 to perform various functions or operations described herein. To this end, the processing circuitry 198 may be any suitable type of computer processor or microprocessor capable of executing computer-executable code, including but not limited to one or more field programmable gate arrays (FPGA), application-specific integrated circuits (ASIC), programmable logic devices (PLD), programmable logic arrays (PLA), and the like. As an example, the control system 194 may be configured to control the reversing valve 156 and/or the first valve 166 based on an operating mode selected from the different operating modes described herein. For instance, the control system 194 may control the position of the first valve 166 to apportion the first portion of the refrigerant directed to the second heat exchanger 160 and the second portion of the refrigerant directed to the reheat heat exchanger 162 to condition the supply air flow in a desirable manner. That is, the control system 194 may adjust the first valve 166 between the first position, the second position, and any of the intermediate positions therebetween.

The control system 194 may also be configured to control the second valve 184 to control refrigerant flow through the second conduit 180 of the conduit system 176 and/or to control the third valve 190 and/or the fourth valve 192 to control drainage of the refrigerant from the reheat flow path 163 and/or from the second flow path 161, respectively. For instance, the valves 184, 190, 192 may be solenoid valves configured to open or close based on signals (e.g., control signals) received from the control system 194. In some embodiments, the signals may cause the valves 184, 190, 192 to close, and the valves 184, 190, 192 may remain open while the signals are not received. In other words, the valves 184, 190, 192 may be normally-open valves. Additionally or alternatively, the signals may cause the valves 184, 190, 192 to open, and the valves 184, 190, 192 may remain closed while the signals are not received. In other words, the valves 184, 190, 192 may be normally-closed valves.

In certain embodiments, the first fan 167 may be a variable speed fan. The control system 194 or a separate control system (e.g., a dedicated control system configured to operate the first fan 167) may be configured to operate the variable speed fan at a target operating speed. For instance, the control system 194 may operate the first fan 167 to direct a target amount (e.g., a target flow rate) of air flow across the second heat exchanger 160 to cool the refrigerant while maintaining a pressure of the refrigerant above a threshold pressure to enable refrigerant flow toward the expansion valve 170 at a threshold or sufficient flow rate. In other words, the control system 194 may operate the first fan 167 to avoid overcooling the refrigerant in the second heat exchanger 160, thereby avoiding reduction of the flow rate of the refrigerant below the threshold flow rate. In additional or alternative embodiments, the first fan 167 may be one of a plurality of fans (e.g., a fan array) that is independently controllable, and the control system 194 may be configured to operate the plurality of fans (e.g., to suspend operation of a subset of the plurality of fans, to individually adjust an operating speed of each fan) to maintain the pressure of the refrigerant above the threshold pressure. To this end, the control system 194 may also operate the first fan 167 based on a determined or measured operating parameter indicative of the pressure of the refrigerant at or exiting the second heat exchanger 160, such as a direct measurement of the pressure of the refrigerant, a temperature of the refrigerant, a flow rate of the refrigerant (e.g., to the expansion valve 170), a temperature of outdoor air (e.g., an ambient temperature), and the like.

To this end, the refrigerant circuit 152 and/or the heat pump system 150 include one or more sensors 200 communicatively coupled to the control system 194. The sensor(s) 200 may be configured to determine an operating parameter of the heat pump system 150, and the sensor(s) 200 may transmit data indicative of the operating parameter to the control system 194. The control system 194 may operate the heat pump system 150 based on the operating parameter. By way of example, the operating parameter may include a temperature and/or pressure of the refrigerant (e.g., within the first heat exchanger 158, within the second heat exchanger 160), a temperature of the supply air flow, a humidity of the supply air flow, a temperature and/or humidity within a space conditioned by the heat pump system 150, an ambient temperature, another suitable operating parameter, or any combination thereof. The control system 194 may operate the valves 156, 166, 184, 190, 192 based on the data received from the sensor(s) 200 in order to operate the heat pump system 150 to condition the supply air flow in a desired manner. The control system 194 may additionally or alternatively operate another suitable component, such as the compressor 154, the first fan 167, the second fan 170, and so forth, based on the data received from the sensor(s) 200.

By way of example, the control system 194 may be configured to position the first valve 166 based on the data received from the sensor(s) 200. For instance, the control system 194 may determine a first temperature of the supply air flow at an outlet or discharge section of the heat pump system 150 (e.g., exiting the heat pump system 150). The control system 194 may also determine a target temperature of the supply air flow (e.g., based on a user input received by the control system 194). The control system 194 may position the first valve 166 to modify the first temperature of the supply air flow toward the target temperature of the supply air flow. That is, the control system 194 may adjust the position of the first valve 166 to apportion refrigerant flow between the second heat exchanger 160 and the reheat heat exchanger 162 to adjust heat transfer between the refrigerant flow and the supply air flow, such that the first temperature approaches or equals the target temperature. As an example, the target temperature of the supply air flow may be a second temperature of a return air flow at an inlet or intake section of the heat pump system 150 (e.g., entering the heat pump system 150). Thus, the control system 194 may adjust the position of the first valve 166 to modify the first temperature to approach or equal the second temperature. As another example, the target temperature of the supply air flow may be a current temperature of the space conditioned by the heat pump system 150. The control system 194 may therefore adjust the position of the first valve 166 to modify the first temperature to equal the current temperature of the space. As such, the control system 194 may position the first valve 166 to acutely control heating (e.g., reheat) of the supply air flow to achieve the target temperature.

The control system 194 may additionally or alternatively position the first valve 166 based on a measured or target humidity of the supply air flow. For example, the control system 194 may determine a target humidity of the supply air flow, such as based on a user input and/or based on a current humidity of the space. The control system 194 may therefore adjust the position of the first valve 166 to modify a humidity of the supply air flow at the discharge section of the heat pump system 150 to approach the target humidity. In this manner, the control system 194 may also position the first valve 166 to acutely control dehumidification of the supply air flow to achieve the target humidity.

It should be noted that additional or alternative embodiments of the heat pump system 150 may include other suitable components to control the flow of refrigerant through the refrigerant circuit 152 in the various operating modes. For example, a single valve (e.g., an on/off valve, a three-way valve) in addition to or as an alternative to the conduit system 176 may be used to control refrigerant flow between the first heat exchanger 158 and the second heat exchanger 160, the drain flow paths 186, 188 may not be incorporated, additional or alternative drain flow paths may be incorporated, alternative valves may be used, and so forth.

Figure 6:
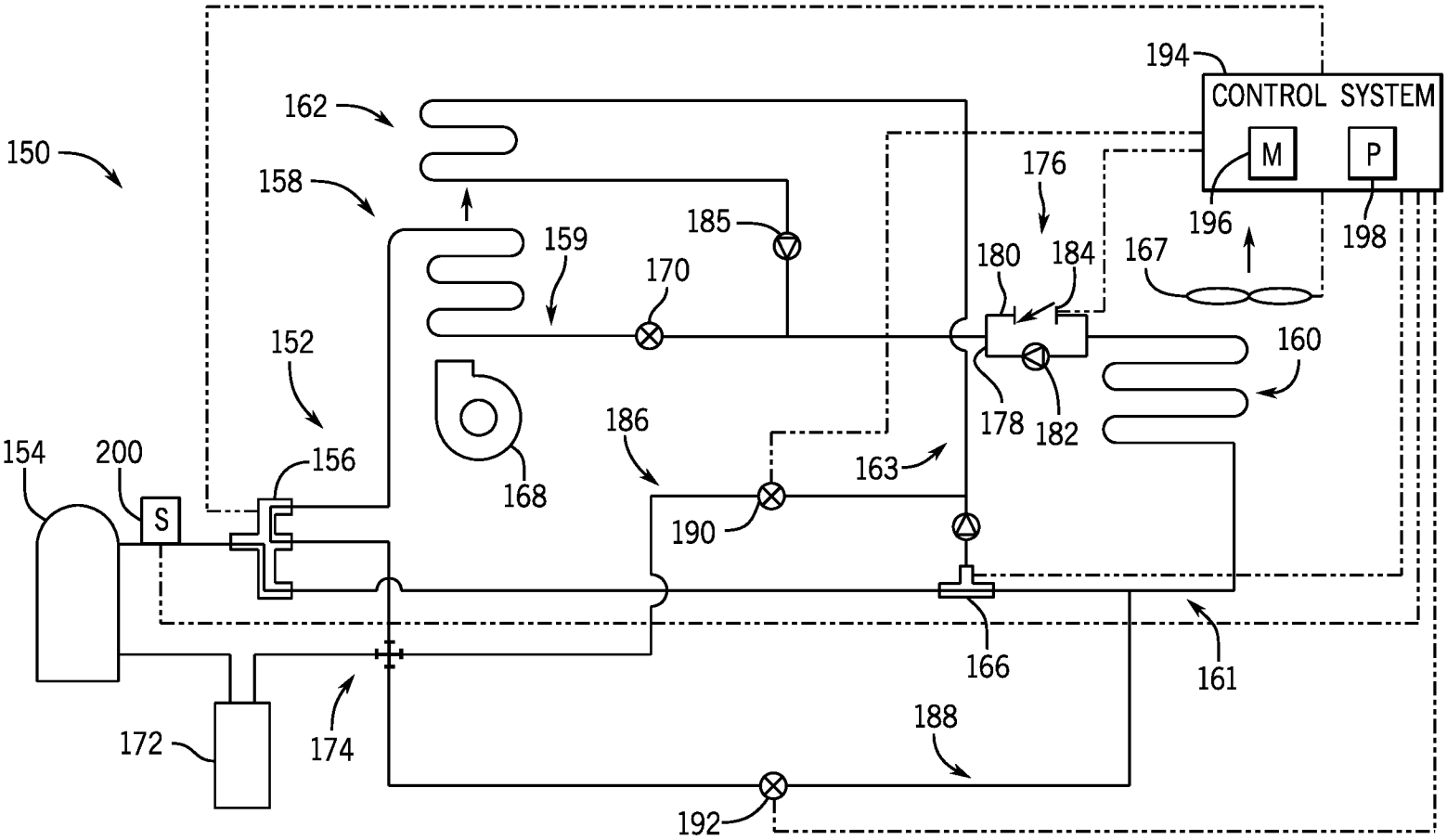
FIG. 6 is a schematic diagram of an embodiment of a heat pump system having reheat functionality and operating in a cooling mode, in accordance with an aspect of the present disclosure.

FIG. 6 is a schematic diagram of an embodiment of the heat pump system 150 in a cooling mode configuration. In the cooling mode, the reversing valve 156 is maintained in the first configuration to direct pressurized refrigerant from the compressor 154 toward the first valve 166, and the first valve 166 is in the first position to block refrigerant flow into the reheat flow path 163. Thus, all of the refrigerant received at the first valve 166 may be directed to the second heat exchanger 160, and the reheat heat exchanger 162 may not be in operation. In this manner, the heat pump system 150 may cool the supply air flow without reheating the supply air flow. For example, the heat pump system 150 may operate in the cooling mode to increase cooling and/or dehumidification of the space (e.g., when reheat of the supply air flow is not desirable). In the cooling mode, the third valve 190 may be opened to enable any remaining refrigerant within the reheat flow path 163 to flow out of the reheat flow path 163 toward the accumulator 172 via the first drain flow path 186. Additionally, the fourth valve 192 may be closed to block refrigerant flow between the second flow path 161 and the junction 174 via the second drain flow path 188.

Figure 7:
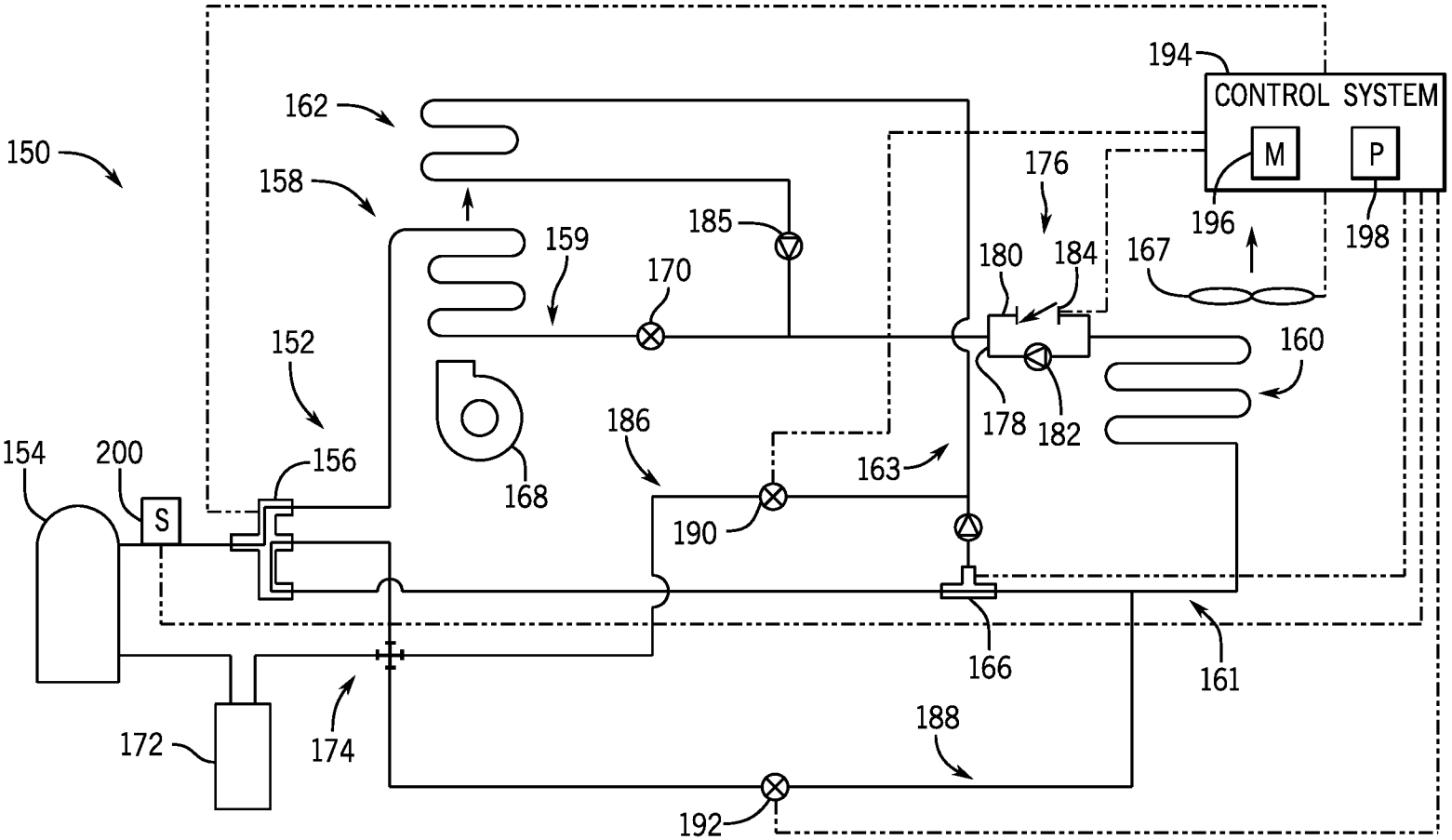
FIG. 7 is a schematic diagram of an embodiment of a heat pump system having reheat functionality and operating in a heating mode, in accordance with an aspect of the present disclosure.

FIG. 7 is a schematic diagram of an embodiment of the heat pump system 150 in a heating mode configuration. In the heating mode, the reversing valve 156 may be positioned in the second configuration to direct the pressurized refrigerant from the compressor 154 to the first heat exchanger 158. The second fan 168 may direct the supply air flow across the first heat exchanger 158 to place the supply air flow in a heat exchange relationship with the pressurized, heated refrigerant in order to heat the supply air flow and cool the refrigerant. The supply air flow may then be directed into the space to heat the space. The check valve 185 may block refrigerant flow from the first heat exchanger 158 to the reheat heat exchanger 162, and the cooled refrigerant may be directed from the first heat exchanger 158 to the conduit system 176. The second valve 184 of the second conduit 180 of the conduit system 176 may be adjusted to the open position during the heating mode of the heat pump system 150 to enable refrigerant flow from the expansion valve 170 to the second heat exchanger 160 via the second conduit 180. The first fan 167 may direct air across the second heat exchanger 160, which may place the refrigerant in a heat exchange relationship with the air (e.g., ambient air) to heat the refrigerant. The refrigerant may then be directed from the second heat exchanger 160 to the first valve 166. The first valve 166 may be positioned (e.g., in the first position) to block refrigerant flow to the reheat heat exchanger 162 and therefore direct the refrigerant from the second heat exchanger 160 to the reversing valve 156. The reversing valve 156 may direct the refrigerant from the first valve 166 to the junction 174 and toward the accumulator 172 in the second configuration.

In the heating mode, refrigerant flow into the reheat flow path 163 may be blocked, and operation of the reheat heat exchanger 162 may be suspended. As such, the third valve 190 may be opened to enable any remaining refrigerant within the reheat flow path 163 to flow out of the reheat flow path 163 toward the accumulator 172 via the first drain flow path 186. Additionally, the fourth valve 192 may be closed to block refrigerant flow between the second flow path 161 and the junction 174 via the second drain flow path 188.

Figure 8:
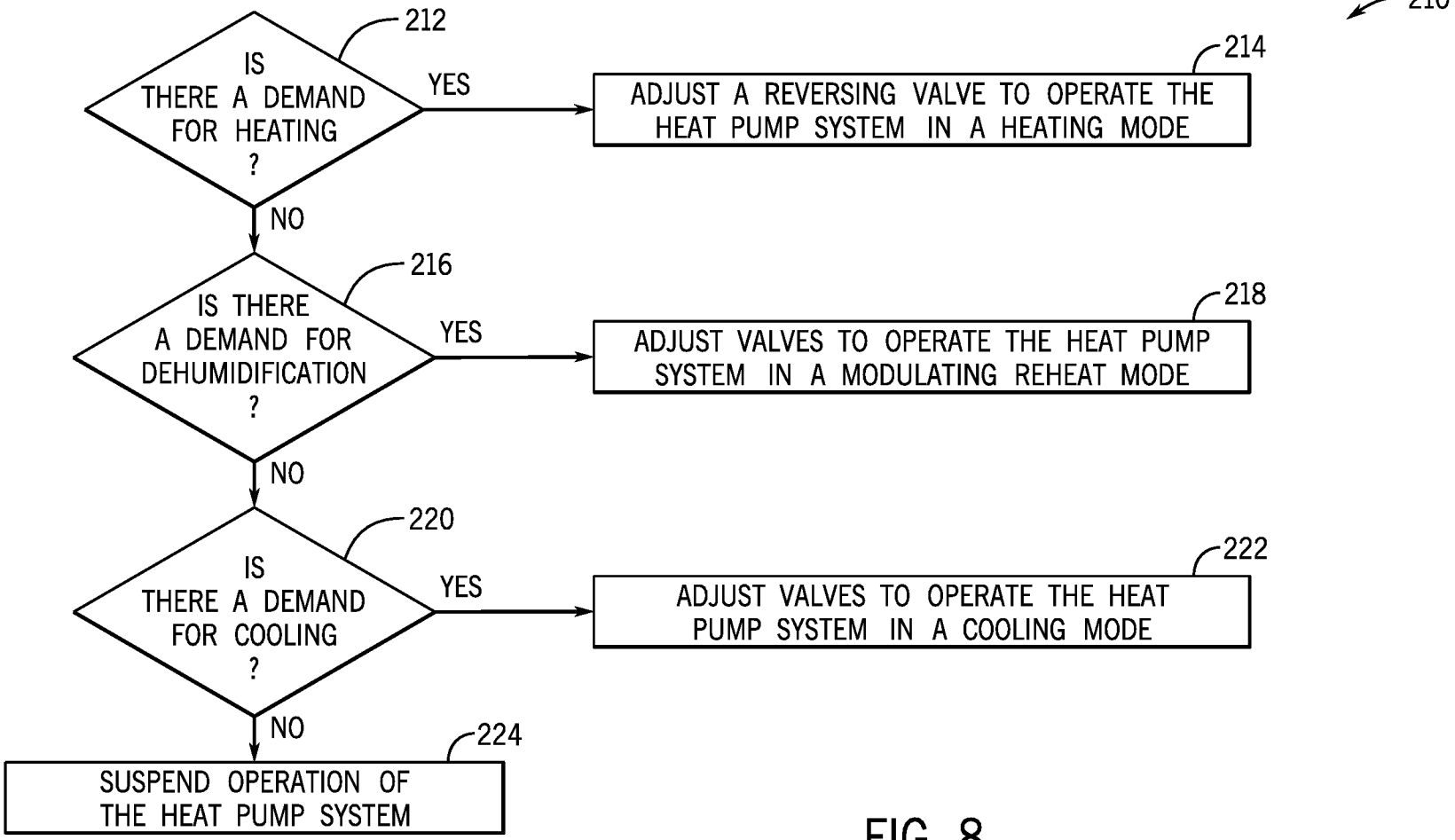
FIG. 8 is a flowchart of an embodiment of a method for operating a heat pump system having reheat functionality, in accordance with an aspect of the present disclosure.

FIG. 8 is a flowchart of an embodiment of a method 210 for operating the heat pump system 150 in different operating modes. As an example, the control system 194 (e.g., the processing circuitry 198) may perform one or more steps in the illustrated method 210. It should be noted that the method 210 may be performed in a different manner in additional or alternative embodiments. For instance, additional steps may be performed with respect to the described method 210. Additionally or alternatively, certain steps of the depicted method 210 may be removed, modified, and/or performed in a different order.

At block 212, a determination is made regarding whether there is a demand for heating. In certain embodiments, the determination may be made based on data received from the sensor(s) 200. As an example, the determination may be made based on a comparison between a current (e.g., measured) temperature within a space serviced by the heat pump system 150 and a target or desired temperature within the space (e.g., indicated by a current or measured temperature of a return air flow received by the heat pump system 150), such as whether the current temperature is below the target temperature. In additional or alternative embodiments, the determination may be made based on a user input. By way of example, the user input may be indicative of a request to heat the space regardless of the current temperature within the space.

At block 214, in response to a determination that there is a demand for heating (e.g., the current temperature of the space is below the target temperature), the heat pump system 150 may be operated in the heating mode. For example, the reversing valve 156 may be maintained in the second configuration to direct pressurized refrigerant to the first heat exchanger 158, as shown in FIG. 7. Concurrently, the first valve 166 may be adjusted to the first position to enable flow of refrigerant from the second heat exchanger 160 to the reversing valve 156 and to block flow of refrigerant from the second heat exchanger 160 to the reheat heat exchanger 162. Thus, operation of the reheat heat exchanger 162 may be suspended. Further, the second fan 168 may be operated to direct the supply air flow across the second heat exchanger 160 to heat the supply air flow to a target temperature and/or to deliver the supply air flow at a desirable flow rate into the space. Further still, the third valve 190 may be opened to enable refrigerant flow out of the reheat flow path 163 and toward the accumulator 172 via the junction 174, and the fourth valve 192 may be closed to block refrigerant flow between the second flow path 161 and the junction 174.

At block 216, in response to a determination that there is not a demand for heating, a determination may be made regarding whether there is a demand for dehumidification. By way of example, the determination for dehumidification may be made based on a comparison between a current (e.g., measured) humidity of the space and a target humidity of the space, such as whether the current humidity is above the target humidity. In additional or alternative embodiments, the determination may be made based on a user input, such as a user input indicative of a request to dehumidify the space (e.g., regardless of the current humidity within the space).

At block 218, in response to a determination that there is a demand for dehumidification (e.g., the current humidity of the space is above the target humidity), the heat pump system 150 may be operated in the modulating reheat mode. In the modulating reheat mode, the reversing valve 156 may be maintained in the first configuration to direct pressurized refrigerant to the second valve 166, as shown in FIG. 5. Concurrently, the first valve 166 may be adjusted to direct the first portion of the refrigerant received at the first valve 166 to the second heat exchanger 160 and the second portion of the refrigerant received at the first valve 166 to the reheat heat exchanger 162. The first valve 166 may be positioned to adjust the first portion and the second portion based on an operating parameter of the heat pump system 150. As an example, the first valve 166 may be positioned to modify the humidity of the supply air flow toward a target humidity. In some embodiments, there may also be a demand for cooling in addition to the demand for dehumidification. In such embodiments, the first valve 166 may also be positioned to modify the temperature of the supply air flow toward a target temperature to cool the space. Indeed, the first valve 166 may be adjusted to any suitable position, including the first position to direct substantially all of the refrigerant from the reversing valve 156 to the second heat exchanger 160 (e.g., to block refrigerant flow from the reversing valve 156 to the reheat heat exchanger 162), the second position to direct substantially all of the refrigerant from the reversing valve 156 to the reheat heat exchanger 162 (e.g., to block refrigerant flow from the reversing valve 156 to the second heat exchanger 160), and any intermediate position between the first position and the second position. Such control of the first valve 166 to apportion the refrigerant flow received at the first valve 166 may enable acute control of the temperature and/or the humidity of the supply air flow.

In some embodiments, the second fan 168 may also be controlled to direct the supply air flow across the first heat exchanger 158 and the reheat heat exchanger 162 to condition the supply air flow to approach a target temperature and/or a target humidity, and/or to deliver the supply air flow at a desirable flow rate into the space. In additional or alternative embodiments, the first fan 167 may be operated to cool the refrigerant flowing through the second heat exchanger 160 while enabling refrigerant flow toward the first heat exchanger 158 at a target flow rate. While the first valve 166 is maintained in the first position (e.g., operation of the reheat heat exchanger 162 is suspended), the third valve 190 may be opened to direct refrigerant from the reheat flow path 163 toward the accumulator 172 via the junction 174, and the fourth valve 192 may be closed to block refrigerant flow between the second flow path 161 and the junction 174. While the first valve 166 is maintained in the second position (e.g., operation of the second heat exchanger 160 is suspended), the fourth valve 192 may be opened to direct refrigerant from the second flow path 161 toward the accumulator 172 via the junction 174, and the third valve 190 may be closed to block refrigerant flow between the reheat flow path 163 and the junction 174. While the first valve 166 is maintained in any of the intermediate positions, each of the third valve 190 and the fourth valve 192 may be closed to block refrigerant flow between the second flow path 161 and the junction 174 and between the reheat flow path 163 and the junction 174, respectively.

At block 220, in response to a determination that there is not a demand for heating or dehumidification, a determination may be made regarding whether there is a demand for cooling. For instance, the determination for cooling may be made based on a comparison between the current (e.g., measured) temperature within the space and the target temperature, such as whether the current temperature is above the target temperature. In additional or alternative embodiments, the determination may be made based on a user input, such as a user input indicative of a request to cool the space (e.g., regardless of the current temperature within the space).

At block 222, in response to a determination that there is a demand for cooling (e.g., the current temperature of the space is above the target temperature) and no demand for dehumidification, the heat pump system 150 may be operated in the cooling mode. In the cooling mode, the reversing valve 156 may be maintained in the first configuration to direct pressurized refrigerant to the second valve 166, and the first valve 166 may be adjusted to the first position to direct substantially all of the refrigerant from the reversing valve 156 to the second heat exchanger 160, as shown in FIG. 5, thereby blocking refrigerant flow from the reversing valve 156 to the reheat heat exchanger 162. In this manner, in the cooling mode, operation of the reheat heat exchanger 162 may be suspended, and the heat pump system 150 may operate to cool the supply air flow without reheating the supply air flow.

At block 224, in response to a determination that there is no demand for heating, cooling, or dehumidification, operation of the heat pump system 150 may be suspended. For example, operation of the compressor 154 may be suspended such that the refrigerant is not directed through the refrigerant circuit 152. Further, operation of other components (e.g., the first fan 167, the second fan 170) may be suspended to reduce energy consumption associated with operation of the heat pump system 150.

It should be noted that any of blocks 212, 216, 220 may be continually performed to determine a suitable or desired operating mode of the heat pump system 150. As an example, presence of a demand for heating, cooling, or dehumidification may be continually monitored while the heat pump system 150 is operating in the heating mode or the modulating reheat mode, such as to determine whether a current operating mode is to be maintained and/or is to be changed to a different operating mode. As another example, presence of a demand for heating, cooling, or dehumidification may be continually monitored while operation of the heat pump system 150 is suspended, such as to determine whether operation of the heat pump system 150 is to remain suspended or whether a particular operating mode of the heat pump system 150 is to be initiated.

The present disclosure may provide one or more technical effects useful in the operation of an HVAC system. For example, the HVAC system may include a heat pump system configured to operate a refrigerant circuit in a heating mode and a modulating reheat mode. In the heating mode, a reversing valve may direct pressurized refrigerant to a first heat exchanger, such as an indoor heat exchanger, to heat a supply air flow. In the modulating reheat mode, the reversing valve may direct pressurized refrigerant to a modulating valve. The modulating valve may be controlled to direct a first portion of the refrigerant to a second heat exchanger, such as an outdoor heat exchanger, and/or a second portion of the refrigerant to a reheat heat exchanger. The second heat exchanger may cool the pressurized refrigerant before directing the cooled refrigerant to the first heat exchanger to cool the supply air flow and remove an amount of moisture contained within the supply air flow to dehumidify the supply air flow. The reheat heat exchanger may heat (e.g., reheat) the cooled, dehumidified supply air flow to a higher temperature (e.g., toward a target temperature). Indeed, the modulating valve may be controlled to provide improved conditioning of the supply air flow, such as to more acutely control the temperature and/or the humidity of the supply air flow, by adjusting the first portion of the refrigerant relative to the second portion of the refrigerant. In this manner, the heat pump system may be configured to operate in different manners to enable improved conditioning of a space serviced by the heat pump system. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A heat pump system, comprising:

a refrigerant circuit comprising a compressor, a first heat exchanger, a second heat exchanger, a reheat heat exchanger, a modulating valve, a reversing valve, and a drain conduit, wherein the reversing valve is configured to receive refrigerant from the compressor and to adjust between a first configuration to direct the refrigerant from the compressor toward the modulating valve and a second configuration to direct the refrigerant from the compressor toward the first heat exchanger, wherein the modulating valve is configured to apportion the refrigerant received from the reversing valve between a first flow path extending from the modulating valve to the second heat exchanger and a reheat flow path extending from the modulating valve to the reheat heat exchanger, and wherein the drain conduit extends from the reheat flow path toward the compressor.

2. The heat pump system of claim 1, wherein the drain conduit is a first drain conduit, and the refrigerant circuit comprises a second drain conduit extending from the first flow path toward the compressor.

3. The heat pump system of claim 2, wherein the first drain conduit extends from the reheat flow path to a junction of the refrigerant circuit, and the second drain conduit extends from the first flow path to the junction of the refrigerant circuit.

4. The heat pump system of claim 3, wherein the reversing valve is configured to receive the refrigerant from the first heat exchanger and to direct the refrigerant received from the first heat exchanger toward the compressor via the junction in the first configuration.

5. The heat pump system of claim 4, wherein the reversing valve is configured to receive the refrigerant from the modulating valve and direct the refrigerant received from the modulating valve toward the compressor via the junction in the second configuration.

6. The heat pump system of claim 4, wherein the refrigerant circuit comprises an accumulator configured to receive the refrigerant from at least one of the first drain conduit, the second drain conduit, or the reversing valve via the junction, wherein the accumulator is configured to direct the refrigerant to the compressor.

7. The heat pump system of claim 2, comprising a first drain valve disposed along the first drain conduit and configured to selectively enable flow of the refrigerant therethrough.

8. The heat pump system of claim 7, comprising a second drain valve disposed along the second drain conduit and configured to selectively enable flow of the refrigerant therethrough.

9. The heat pump system of claim 8, comprising control circuitry configured to adjust the first drain valve and the second drain valve based on respective positions of the reversing valve and the modulating valve.

10. The heat pump system of claim 1, wherein the refrigerant circuit is configured to direct a first portion of the refrigerant from the modulating valve to the second heat exchanger via the first flow path and to direct a second portion of the refrigerant from the modulating valve to the reheat heat exchanger via the reheat flow path in parallel with one another.

11. A control system for a heat pump system, wherein the control system comprises:

processing circuitry; and a tangible, non-transitory, computer-readable medium comprising instructions, wherein the instructions, when executed by the processing circuitry, are configured to cause the processing circuitry to:

position a reversing valve of the heat pump system in a first configuration to direct refrigerant from a compressor of the heat pump system toward a modulating valve of the heat pump system in a modulating reheat mode of the heat pump system; and adjust a position of the modulating valve to an intermediate position of a plurality of intermediate positions in the modulating reheat mode, wherein the plurality of intermediate positions is between a first position of the modulating valve and a second position of the modulating valve, and wherein, in each intermediate position of the plurality of intermediate positions, the modulating valve is configured to direct a first portion of the refrigerant along a first flow path to a first heat exchanger of the heat pump system and to direct a second portion of the refrigerant along a reheat flow path to a reheat heat exchanger of the heat pump system, wherein the first heat exchanger is configured to place the refrigerant in a first heat exchange relationship with an outdoor air flow, and the reheat heat exchanger is configured to place the refrigerant in a second heat exchange relationship with a supply air flow.

12. The control system of claim 11, wherein the instructions, when executed by the processing circuitry, are configured to cause the processing circuitry to position the reversing valve in a second configuration to direct the refrigerant from the compressor toward a second heat exchanger of the heat pump system in a heating mode of the heat pump system, wherein the second heat exchanger is configured to place the refrigerant in a third heat exchange relationship with the supply air flow.

13. The control system of claim 11, wherein the instructions, when executed by the processing circuitry, are configured to cause the processing circuitry to:

adjust the modulating valve to the first position to block flow of the refrigerant to the reheat heat exchanger; and adjust a drain valve disposed along a drain conduit extending from the reheat flow path toward the compressor to an open position to enable flow of the refrigerant from the reheat flow path toward the compressor when the modulating valve is in the first position.

14. The control system of claim 13, wherein the drain valve is a first drain valve, the drain conduit is a first drain conduit, and wherein the instructions, when executed by the processing circuitry, are configured to cause the processing circuitry to adjust a second drain valve disposed along a second drain conduit extending from the first flow path toward the compressor to a closed position to block flow of the refrigerant from the first flow path toward the compressor when the modulating valve is in the first position.

15. The control system of claim 11, wherein the instructions, when executed by the processing circuitry, are configured to cause the processing circuitry to:

adjust the modulating valve to the second position to block flow of the refrigerant from the reversing valve to the first heat exchanger; and adjust a drain valve disposed along a drain conduit extending from the first flow path toward the compressor to an open position to enable flow of the refrigerant from the first flow path toward the compressor when the modulating valve is in the second position.

16. The control system of claim 15, wherein the drain valve is a first drain valve, the drain conduit is a first drain conduit, and wherein the instructions, when executed by the processing circuitry, are configured to cause the processing circuitry to adjust a second drain valve disposed along a second drain conduit extending from the reheat flow path toward the compressor to a closed position to block flow of the refrigerant from the reheat flow path toward the compressor when the modulating valve is in the second position.

17. The control system of claim 16, wherein the instructions, when executed by the processing circuitry, are configured to cause the processing circuitry to adjust the second drain valve to the closed position and adjust the first drain valve to an additional closed position when the modulating valve is in the intermediate position of the plurality of intermediate positions.

18. A heat pump system, comprising:

a refrigerant circuit comprising a compressor, an indoor heat exchanger, an outdoor heat exchanger, a reheat heat exchanger, a modulating valve, a reversing valve, and a conduit system extending between the indoor heat exchanger and the outdoor heat exchanger; and a control system configured to control the modulating valve and the reversing valve, to adjust operation of the heat pump system between a cooling mode, a modulating reheat mode, and a heating mode, wherein:

the modulating valve is configured to direct a first portion of the refrigerant from the modulating valve to the outdoor heat exchanger and to direct a second portion of the refrigerant from the modulating valve to the reheat heat exchanger in parallel with one another.

19. The heat pump system of claim 18, wherein the conduit system comprises a first conduit and a second conduit arranged in parallel with one another, the first conduit comprises a check valve configured to block flow therethrough to the outdoor heat exchanger, and the second conduit comprises a solenoid valve that is adjustable between an open position and a closed position.

20. The heat pump system of claim 19, wherein the control system is configured to adjust the solenoid valve to the closed position in the modulating reheat mode and to adjust the solenoid valve to the open position in the heating mode.

* * * * *